United States Patent [19]

Seedorf et al.

[11] 4,075,448

[45] Feb. 21, 1978

[54] CELL BYPASS SWITCHES FOR ELECTROCHEMICAL CELL SYSTEMS

[75] Inventors: Jack H. Seedorf, North Tonawanda; Robert M. Hruda, Horseheads, both of N.Y.; Donald E. Abell, Chesterfield, Mo.

[73] Assignee: Hooker Chemicals & Plastics Corporation, Niagara Falls, N.Y.

[21] Appl. No.: 617,760

[22] Filed: Sept. 29, 1975

[51] Int. Cl.[2] ..... H01H 1/02; H01H 33/00

[52] U.S. Cl. ..... 200/262; 200/5 B; 200/83 C; 200/144 B; 200/266

[58] Field of Search ..... 75/170; 200/262, 264, 200/265, 266, 267, 144 B, 5 B, 83 C

[56] References Cited

U.S. PATENT DOCUMENTS

| | | | |
|---|---|---|---|
| 3,700,842 | 10/1972 | Attia | 200/144 B |
| 3,738,829 | 6/1973 | Sato | 75/170 |
| 3,839,612 | 10/1974 | Badey et al. | 200/144 B |
| 3,950,628 | 4/1976 | Hruda | 200/144 B |

OTHER PUBLICATIONS

*Electrochemical Engineering*, C. L. Mantell, McGraw--Hill Book Co., Inc., New York, copyright 1960, pp. 257-277.

*Primary Examiner*—Bruce A. Reynolds
*Assistant Examiner*—N. D. Herkamp
*Attorney, Agent, or Firm*—Peter F. Casella; Howard M. Ellis; Thomas T. Gordon

[57] ABSTRACT

An electrochemical cell circuit has vacuum interrupter cell by-pass switches provided in order to prevent the impurities in the environment, caused by leakage from the electrochemical cells, from interfering with the switch operation.

21 Claims, 8 Drawing Figures

CELL BYPASS SWITCHES FOR ELECTROCHEMICAL CELL SYSTEMS

BACKGROUND OF THE INVENTION

This invention relates to electrochemical systems for the production of chlorine and caustic having vacuum interrupter switches for cell shorting, and more particularly, to mercury cell electrochemical systems having vacuum interrupter switches.

According to one method of electrolyzing sodium chlorine brine to yield caustic soda and chlorine, the electrolysis is carried out in a mercury cell in which chlorine is liberated at the anode and the sodium is liberated at the cathode, the sodium forming an amalgam with the mercury. Mercury cells are characterized by the presence of a conducting surface inclined slightly from the horizontal in the longitudinal direction. A mercury amalgam film, typically from about $\frac{1}{8}$ of an inch to about $\frac{1}{4}$ of an inch or more in thickness flows across this plate in the direction of the inclination thereof. The flowing mercury amalgam film is the cathode.

Flowing on top of the amalgam is the electrolyte, that is, the aqueous sodium chloride solution. Typically, the electrolyte is of a thickness of from about $\frac{1}{4}$ of an inch to about 2 inches or more at the inlet and as much as 10 or 12 inches at the outlet.

Anodes, such as carbon anodes or metallic anodes are usually spaced about $\frac{1}{8}$ of an inch to about 3/16 of an inch above the surface of the mercury-amalgam film. In this way, electrical current can flow from the anodes through the electrolyte to the flowing mercury amalgam cathode. Structurally, a group of anodes are mechanically supported by and commonly movable on a frame or structural member which is electrically insulated from the cell body. Several anodes connected to a single conductor and arrayed laterally across the width of the cell are referred to as an anode row. A group of anode rows supported by a common frame or structural member are referred to as an anode bank.

In a typical electrolytic cell, there are a number of these anode banks arrayed along the longitudinal axis of the cell. For example, a typical cell may be 60 or 70 feet long and have anywhere from about 6 to about 30 anode rows arrayed along the length of the cell in about 4 to about 8 banks.

In a typical cell circuit, a plurality of individual cells are arranged in series. Typically, two or more rows of cells are in side-by-side relationship with the positive terminal of a power source being connected to the anodes of the end cell of the first row of cells and the negative terminal of the power source being connected to the cathodes of the end cell of the last row of cells. Within the series circuit, the cathodes of one cell are connected to the anodes of the next adjacent cell in the series. Typically, there may be from 30 to 80 cells in a cell circuit, although there may be more or less.

Cell by-pass switches are situated between the anode and the cathode conductors of each cell and are in the open position when the cell is in operation. When it is desired to shut off the current to a particular cell, the cell by-pass switch for that cell is placed in the closed position. Because the current path from the cell anode to the cell cathode (through the brine) has a much greater resistance than the current path through the switch, no current flows through the cell anode when the switch is in the closed position.

In the operation of mercury amalgam cathode cells, typically a very large current of from about 1000 amperes to about 120,000 amperes passes through the series of cells which operate at about a 5 volt potential difference between the anode and cathode of each cell. As a result, when the cell by-pass switch is operated, the large instantaneous change of current through the switch may give rise to an arc of considerable proportions across the switch contacts.

Typical cell by-pass switches generally comprise two elements: a switch driving mechanism, and one or more circuit interrupter assemblies. Throughout this specification, the following definitions will be used:

A *circuit interrupter* (also referred to herein as "interrupter") is the entity which contains the contact surfaces through which the electrical current passes when the surfaces are in contact (closed position).

A *circuit interrupter assembly* comprises one or more circuit interrupters mounted on a chassis. The one or more interrupters are connected in parallel and are mounted on the chassis in such a way that they open and close in concert when the drive mechanism is activated.

A *cell by-pass switch* comprises one or more "circuit interrupter assemblies" all in mechanical connection with a single drive mechanism so that the switch assemblies open and close in concert. Thus, the "cell by-pass switch" is the entire apparatus which performs the function of electrically by-passing an individual cell.

In prior art cell by-pass switches used in electrochemical systems, the circuit interrupters typically have contact surfaces which are open to the atmosphere and which are closed by the usual mechanical means. An example of one such circuit interrupter is the Burndy Type HSG High Current Switch sold by Burndy Co., Norwalk, Conn. 06856. The use of such circuit interrupters on electrochemical cells has several drawbacks.

First, the contact surfaces of the interrupters exposed to the environment and atmosphere of the cell rooms tend to become coated with foreign materials from brine and caustic, which may leak from the cells onto the interrupters, or by chlorine gas which may be present in the atmosphere. As a result, conducting surface contact will be less than complete, and the presence of high resistance foreign materials between the contact surfaces may cause the interrupter to become hot when it is in the closed position. The presence of resistive matter on the contact surfaces of the interrupter can also prevent it from effectively shutting off current going to the anode, thus necessitating the premature replacement of the interrupter. A second problem with interrupters having contacts open to the atmosphere is that arcing takes place whenever the switch is opened or closed. This phenomenon is intensified when the arc occurs in the ambient air and increases pitting of the contact surfaces, thus, shortening the operational lifetime of the interrupter. Finally, there is the possibility that an open arc may ignite a flammable gas, such as $H_2$, which may be present in the plant atmosphere.

In an electrochemical system, the problems listed above are aggravated because the cells are connected in series. Thus, the power to all of the cells in the plant must be shut off in order to replace an interrupter that has become non-operational.

SUMMARY OF THE INVENTION

In an electrochemical cell circuit, a cell by-pass switch is provided with a plurality of vacuum circuit interrupters which have contact members enclosed in a sealed evacuated envelope. In a preferred embodiment the envelope is resistant to the highly corrosive atmosphere of the electrolytic cell room which may contain chlorine gas, brine, and other corrosive contaminants.

The use in an electrochemical cell circuit of a vacuum interrupter having contact surfaces sealed in an evacuated envelope avoids the above described problems presented by interrupters presently in use. First, because contact surfaces are protected from the environment, the surfaces stay free from contaminants, insuring a resistance free current path when the interrupter is closed. Second, the vacuum environment in the envelope minimizes the arcing problem when the interrupter is opened or closed because no gaseous ionized particles are present to serve as a conductive path between the metal surfaces. Thus, pitting of the contact surfaces is substantially reduced, increasing the life of the interrupter and consequently decreasing the down time of the system as a whole. Finally, the arcing is contained within the evacuated envelope preventing ignition of any flammable gases in the plant atmosphere.

THE DRAWINGS

DETAILED DESCRIPTION

Figure 1:
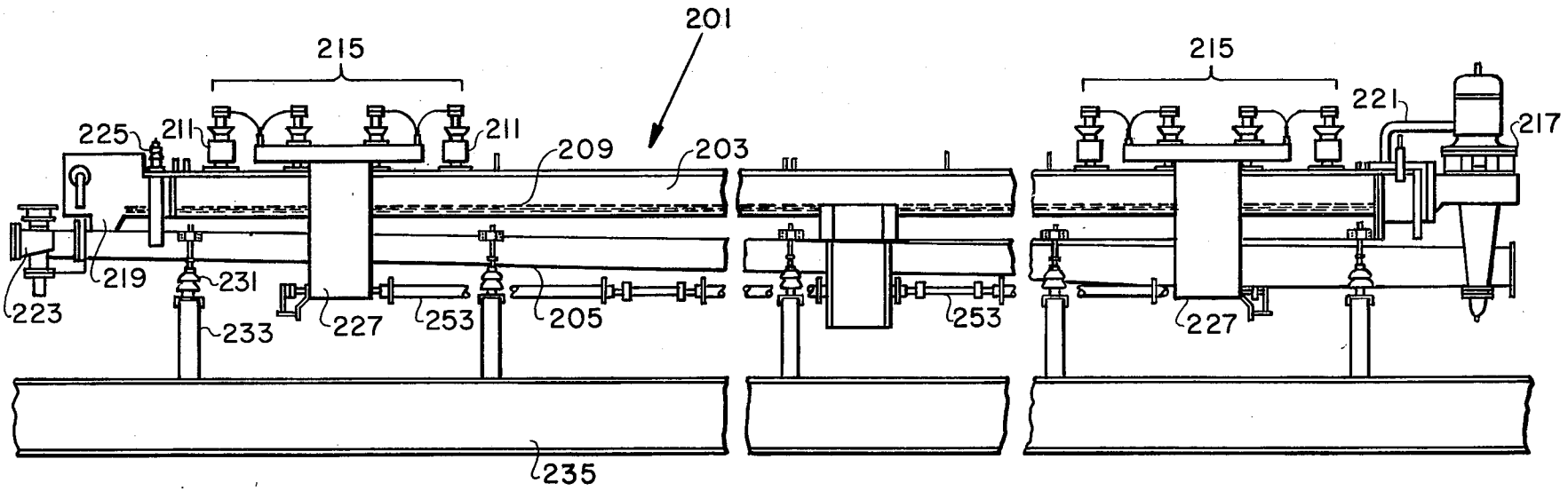
FIG. 1 is a fragmented elevation view cross section of a mercury amalgam cell.
Figure 3:
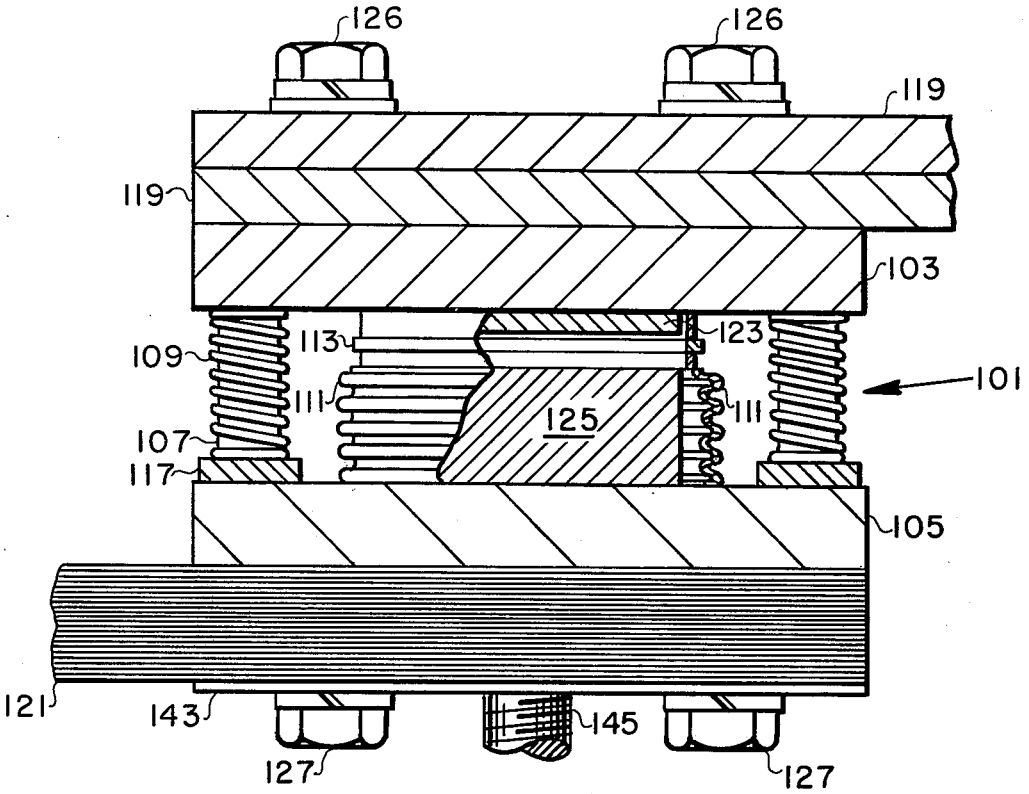
FIG. 3 is a fragmented elevation view cross section of a vacuum interrupter switch.
Figure 4:
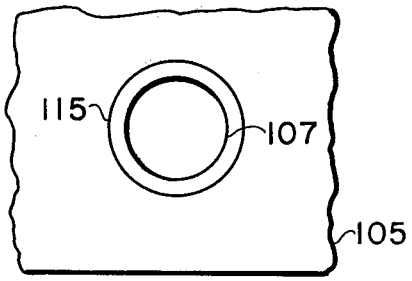
FIG. 4 is a fragmented plan view of the lower end plate 105 of the vacuum interrupter switch showing the guide pin and nylon sleeve assembly.
Figure 5:
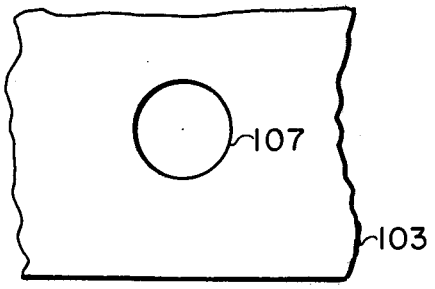
FIG. 5 is a fragmented elevation view of the upper end plate 103 of the vacuum interrupter switch showing the guide pin.

In a particular embodiment of the invention, mercury amalgam electrolytic cells 201 have cell by-pass switches which are provided with a plurality of vacuum circuit interrupters 101, FIG. 3. Each cell, as shown in FIG. 1, is comprised of a primary or electrolyzing section 203 and a secondary or denuding section 205 which functions as the amalgam decomposer. The electrolytic section consists of a long rectangular trough having cathode connection means (not shown) to the lower surface of the trough bottom which makes intimate contact through the conductive material of the trough bottom with a thin layer of mercury 209 which covers the upper surface of the trough bottom and forms the cathode of the cell. The cover of the trough (insulated from the trough bottom) has anodes 211 arranged in a series of anode banks 215. Mercury amalgam cells are well known in the art and are described in detail in *Electrochemical Engineering,* Mantell, McGraw-Hill Book Company, New York, N.Y. (4th Ed. 1960), pp. 257–277. That disclosure is incorporated herein by reference.

The secondary element 205 is formed by a rectangular enclosed trough of substantially the same length as the primary cell. The lower surface of this trough contains decomposer grids (not shown) which may be substantially along the entire length of the trough. Both the primary and secondary troughs are supported by an I beam 235 through supports 233. The supports are provided with insulating means 231 to provide insulation from the troughs.

The electrolytic and denuder troughs are connected on one side by a pump 217 for the circulation of the mercury and on the other side by a device 219 through which the mercury flows from the primary to the secondary trough. Both elements may have a slight slope, in opposite directions, assuring good circulation of the mercury so that the distance between the primary trough and secondary trough is greatest at the pump end.

The primary trough is also provided with a brine inlet 221 and outlet 223 and a chlorine outlet 225. Caustic and hydrogen outlets (not shown) are provided from the amalgam decomposer 205.

Figure 2:
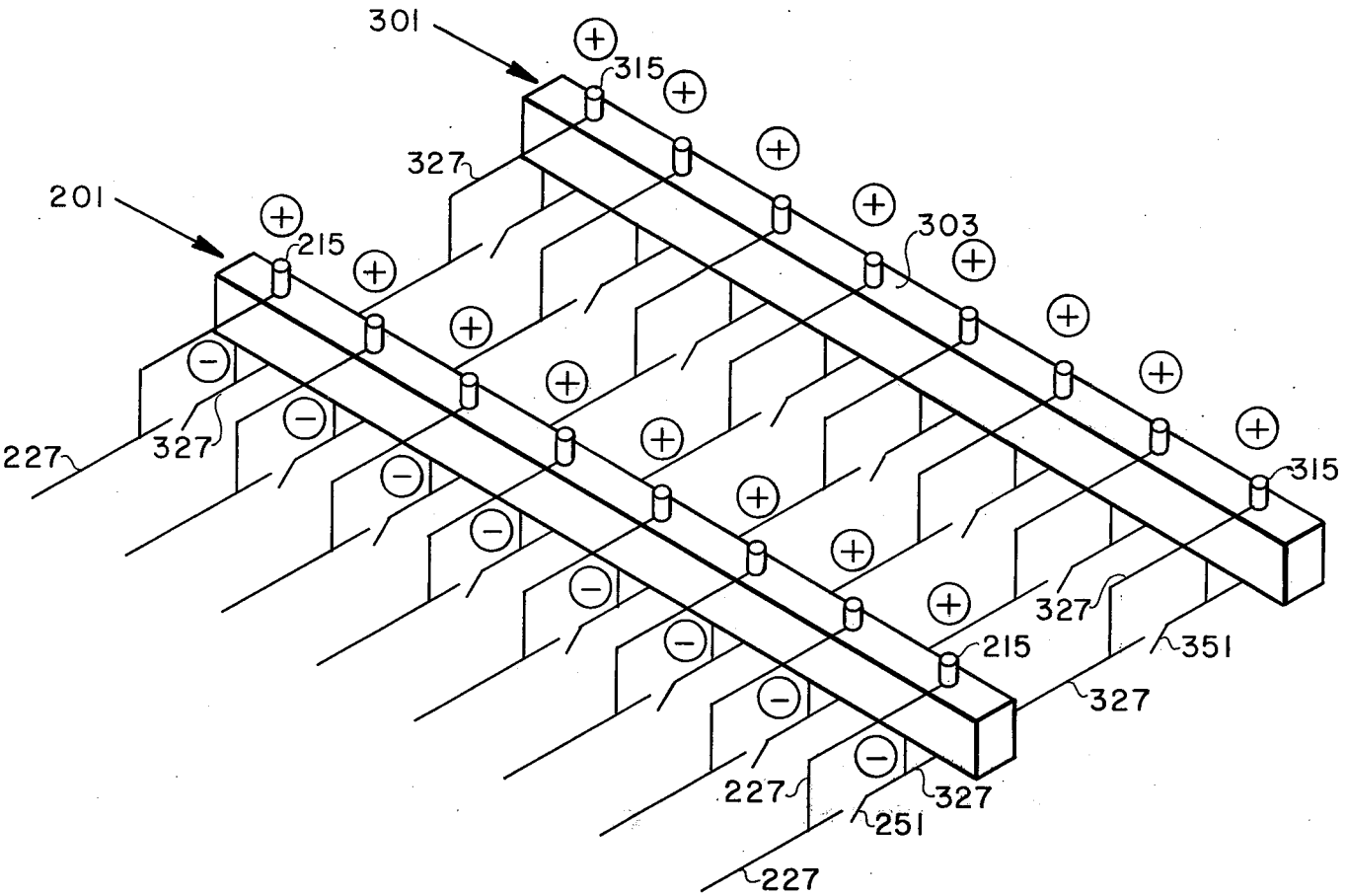
FIG. 2 is a diagrammatic sketch of part of the mercury cell circuit.

In a preferred embodiment, the electrolyzing section 203 of each cell has 8 rows of anode banks 215. Each anode bank 215 consists of 12 anodes 211 and is connected in series with the cathode/anode connection means 327 of the corresponding anode bank 315 on the adjacent cell 301, as shown in FIG. 2. The current flows from the anode 211 of a cell 201, through the brine, to the cathode, and then to the anode of adjacent cell 301 by means of the cathode/anode connection means 327, which may comprise a copper busbar.

A vacuum circuit interrupter assembly 251, shown in FIG. 7, (hereinafter referred to as "switch assembly") is provided between the cathode/ anode connection means 227 and the cathode/anode connection means 327. Thus, for each cell in a preferred embodiment there are eight switch assemblies. Each switch assembly comprises a plurality of vacuum circuit interrupters 101 in parallel and in mechanical connection with a single assembly driving mechanism 253 which, in preferred embodiment, is a rotational drive shaft. In a preferred embodiment, four vacuum circuit interrupters are used on each switch assembly. However, the number used in any particular embodiment will depend on the current capacity of the vacuum circuit interrupters and the current load each switch assembly must carry. The assembly driving mechanism 253 is mechanically linked to a master driving means (not shown) which operates all eight switch assemblies 251 substantially simultaneously.

The vacuum circuit interrupter 101, shown in FIG. 3, of a preferred embodiment of the invention has upper and lower end plates 103 and 105 which may be made of any conductive material and are preferably made of copper; or, more preferably, of oxygen free, high conductivity copper. Between the end plates are disposed guide pins 107 with spring members 109 and flexible bellows 111. The flexible bellows 111 are of a generally cylindrical shape; are sealingly secured to one end plate, and are also sealingly secured in insulated arrangement to the other end plate so that an evacuated airtight chamber is formed. In a preferred embodiment the insulating means 113 may be a ceramic ring. The bellows may be made from any flexible air impermeable corrosive resistant material and are preferably made of an alloy which is by weight from about 66 to about 68 percent nickel, from about 2 to about 4 percent iron, in the range of about 2 percent manganese and about 28 percent copper. In order to further protect the bellows against corrosion, an elastomeric coating may be provided which can be, for example, Dow Corning 805 silicone resin.

Figure 6:
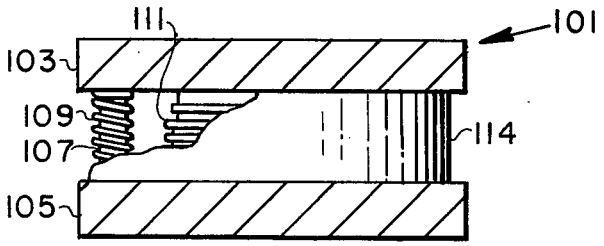
FIG. 6 is a fragmented elevation view of the vacuum interrupter switch having an elastomeric sleeve covering the guide pins and bellows.

In another preferred embodiment, the bellows may be in convoluted form to improve flexibility. To prevent the convolutions from being coated with, or filled with, foreign materials, it may also be preferred to place an elastomeric sleeve 114 around the guide pins and envelope, as shown in FIG. 6, so that the sleeve and inner surfaces of the end plates form an enclosed area.

The guide pins 107 are secured in mechanical connection to the upper end plate 103. They are in insulated sliding engagement with the lower end plate 105. This engagement is provided by an insulating sleeve 115 which can, for example, be of nylon composition. The diameter of the sleeve is of sufficient size so that the guide pin can move freely in the vertical direction but is sufficiently small so that the guide pin will not travel an appreciable distance in the horizontal direction. The guide pin is of such length that when the switch is in the closed (contact) position, the end of the pin 107 is sufficiently far from the outer side of the end plate so as not to make electrical contact with the lower conductor (flexible strap) 121.

A spring 109 is mounted about each guide pin 107 and has sufficient strength to provide a restoring force to hold the contact members in the open (non-contact) position. The spring must be insulated from at least one end plate in order to avoid shorting out the switch. This insulation can be provided by insulating pads 117 which can be of nylon or other suitable material.

Secured to the inner surfaces of the end plates, and in conductive arrangement therewith, within the evacuated airtight enclosure defined by the bellows, insulating ceramic ring, and end plates, are contact members 123 and 125 which are preferably a copper bismuth alloy. The contact surfaces of the contact members are substantially flat and in substantially parallel arrangement so that the gap between the contact surfaces is on the order of about $\frac{1}{8}$ inch. In the preferred embodiment, the contact members are of substantially cylindrical shape and the contact surfaces have diameters on the order of about $2\frac{3}{8}$ inches. These and other dimensions are given merely by way of example and obviously are dependent on the particular electrical parameter requirements of any particular electrochemical system in which the vacuum circuit interrupters might be used.

The end plates 103 and 105 of the vacuum interrupter are conductively secured to the upper conductor 119 and lower conductor 121 by mechanical means 126 and 127 respectively. The interrupter may be oriented with end plate 103 attached to either upper conductor 119 or lower conductor 121. At least one of these conductors should be of sufficient flexibility so that one end plate may travel a distance sufficient to move the contact surfaces in and out of electrical contact. If can, for instance, be a laminate of 100 laminations of dead soft copper.

In a preferred embodiment, the vacuum circuit interrupter 101 is mounted in the circuit with upper end plate 103 connected to the upper conductor 119 of a cell by connecting means 126. The lower end plate 105 is connected to one end of a flexible conductor 121 by mechanical means 127. The other end of flexible conductor 121 is conductively secured to the cathode/anode connection means 327 by water cooling plate 134 and by mechanical means 130. A water cooling pipe, 132 is brazed onto the water cooling plate 134.

Figure 7:
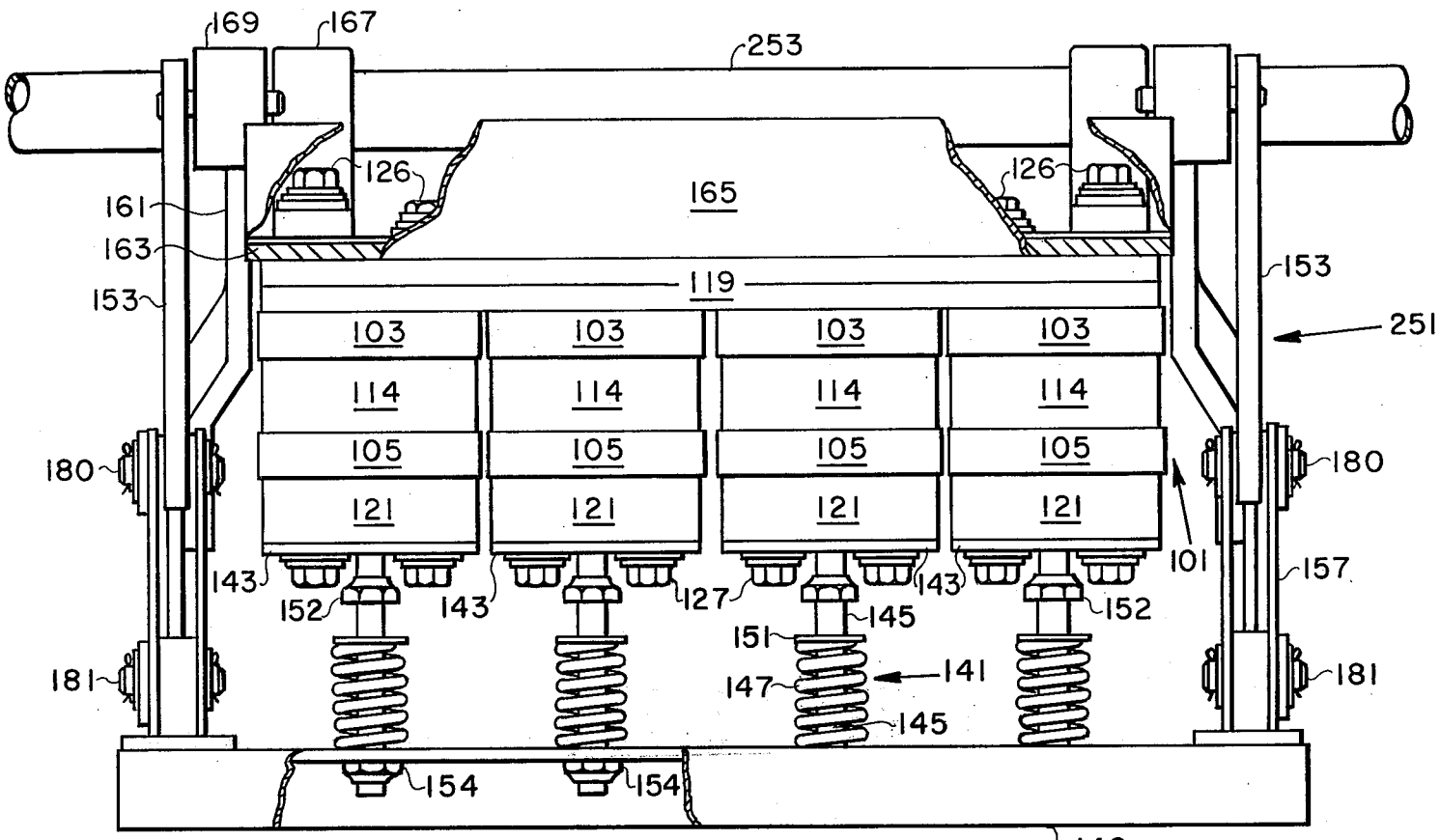
FIG. 7 is an elevation view of a vacuum interrupter switch assembly taken along the side of the cell.
Figure 8:
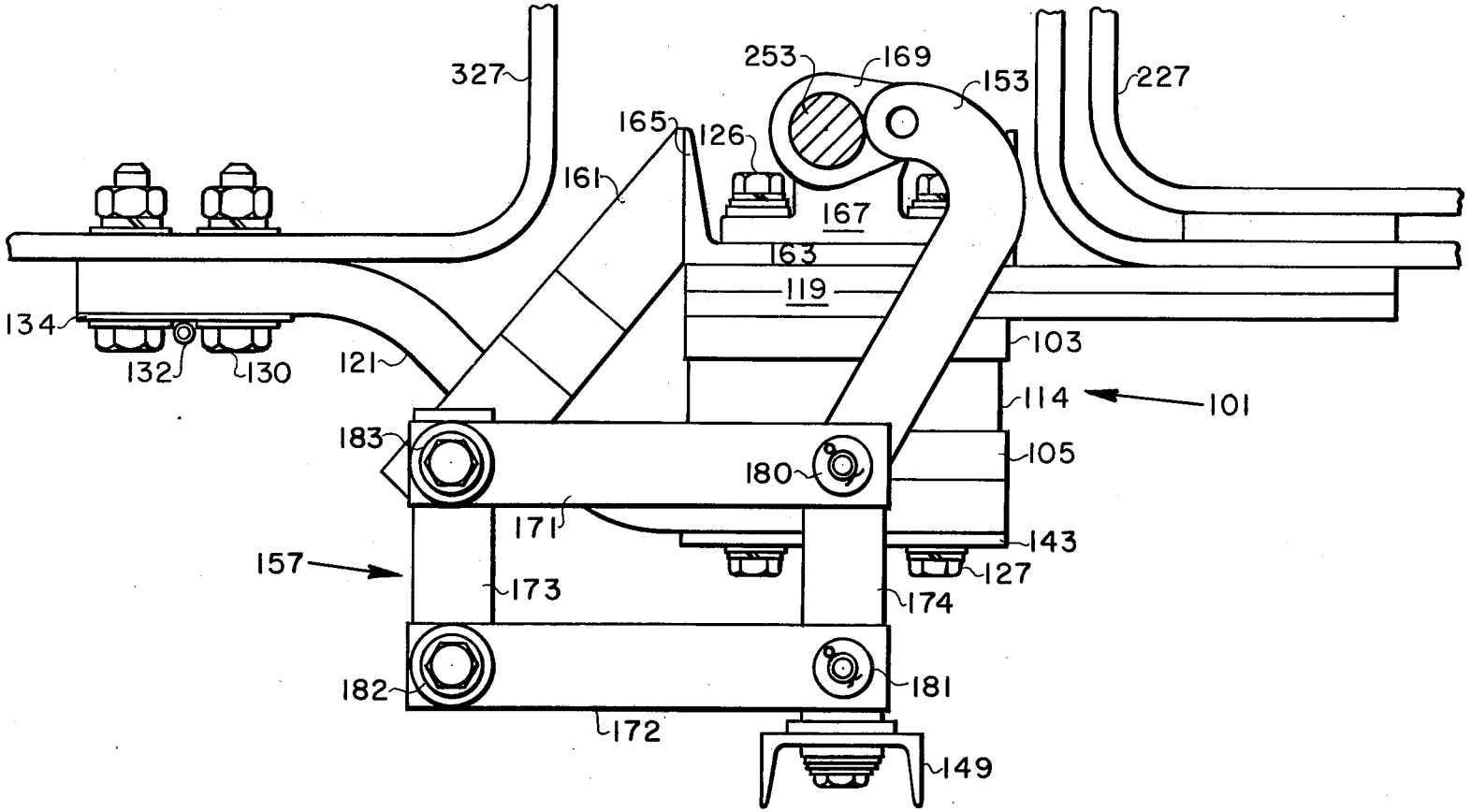
FIG. 8 is an elevation view of a vacuum interrupter switch assembly taken at a right angle to the view of FIG. 7.

The flexible conductor 121 is in mechanical connection with switch drive composite 141, FIG. 7 and 8. The switch drive composite 141 may comprise a drive plate 143, a drive rod 145, a compression spring 147, a compression spring washer 151, a compression spring adjustment nut 152 which is preferably a flex lock nut, an assembly drive channel 149, and a contact opening adjustment nut 154. The drive plate 143 is connected to the flexible strap 121 by mechanical means 127. The drive rod 145 is mechanically connected to the drive plate 143 and extends down through the assembly drive channel 149 and is in movable arrangement therewith. One end of the compression spring 147 (which in the present embodiment is a coil spring about the drive rod 145) is mechanically confined by the compression spring washer 151 and the adjustment nut 152. The other end of the spring is mechanically confined by the assembly drive channel 149. Each contact opening adjustment nut 154 is adjusted to provide the proper contact separation when the switch is in the open position. Thus, the bottom surface of the web of the assembly drive channel 149 strikes the contact opening adjustment nut with a "hammer blow" when the switch rod 153 moves from the closed to the open position. This hammer blow is transmitted to each contact member 123, 125 to facilitate their separation when the switch rod 153 is moved to the open position.

Each switch assembly 251 may comprise one or more vacuum circuit interrupters 101 which are mounted on a chassis as described above. In a preferred embodiment, an assembly consists of four vacuum circuit interrupters. The assembly drive channel 149 traverses the entire length of a switch assembly. An assembly frame 157 is mechanically secured to each end of the assembly drive channel 149. Each assembly frame 157 comprises an upper horizontal member 171, a lower horizontal member 172, and two members 173, 174 which are in substantially perpendicular arrangement to horizontal bars 171, 172 so that each assembly frame is in a substantially rectangular arrangement. These members are rotatably connected by various pivot means 180, 181, 182, 183 which are well known in the art.

One end of the upper horizontal member 171 is pivotally connected to both a substantially L shaped switch rod 153 and switch assembly yoke 174 through pivot means 180. The other end of the upper horizontal member is pivotally connected to support strap 161 and vertical member 173 by pivot means 183. Support strap 161 sets a point of reference for the movable contact with the switch rod 153. The support strap is rigidly connected to the flange 165 of the support channel 163 by connecting means.

Each switch rod 153 is rotatably mounted on the rotational drive mechanism 253 by rotational mounting means 169. The rotational mounting means 169 for the switch rod may, for example, comprise an eccentric connecting lever, which, because of its eccentricity translates the rotational motion of the rotational drive mechanism to linear motion of the switch assembly yoke 174. The rotational drive mechanism is supported on a bearing 167 which may have stop points for forward rotation and reverse rotation of the rotational drive mechanism 253. For each cell by-pass switch, the rotational drive mechanism is in similar connection with all of the switch rods for all of the switch assemblies of the cell. The driving shaft 253 is also in connection with a singular driving means (not shown). Thus, when the driving shaft 253 is rotated by the driving means, the lower end of the switch rod is raised or lowered, depending upon the direction of rotation of the driving shaft 253, and acts through switch rod yoke connecting means 159, the switch assembly yoke 155, and the assembly frame 157 to raise or lower the assembly drive channel 149 which, in turn, raises or lowers the lower end plate 105 of the vacuum circuit interrupter. The rotation of the driving shaft 253 is controlled such that the lower end plate moves a distance corresponding to the distance between the contact members 123 and 125. In this arrangement, all of the switch assemblies of a cell are operated simultaneously so that the current can by-pass the entire cell.

Although the preferred embodiment of the invention has been described as a combination using a mercury cell electrolytic system for producing chlorine and caustic, the invention is not so limited. Since the environmental problems suggesting the utility of using vacuum interrupters exist in all types of electrolytic plants for producing chlorine and caustic, the invention encompasses combinations of vacuum interrupters in all types of electrolytic systems, such as those described in *Electrochemical Engineering*; Mantell, McGraw-Hill Book Co. (4th ed. 1960); and *Chlorine, Its Manufacture and Uses*, Sconce, Reinhold Publishing Corp. (2d. ed 1967). These disclosures are incorporated herein by reference. Thus, the invention is limited only by the claims.

We claim:

1. In an electrochemical cell circuit having a plurality of electrolytic cells, the improvement comprising a cell by-pass switch having contact surfaces sealed in a corrosive resistant evacuated envelope.

2. The circuit of claim 1 wherein each cell has a plurality of anode banks and cathodes, each anode bank connected in series with a cathode of the next adjacent cell by electrically connective means so that the electrolytic cells are connected in series.

3. The circuit of claim 1 wherein the electrochemical cells are mercury amalgam cells.

4. The circuit of claim 3 wherein each mercury amalgam cell has a plurality of anode banks and cathodes, the anode banks on a cell connected by electrical means in series arrangement with the cathodes of the next adjacent cell so that the cells are in series arrangement.

5. The circuit of claim 1 wherein the contact surfaces of the cell by-pass switch are contained in a vacuum circuit interrupter.

6. The circuit of claim 5 wherein the vacuum circuit interrupter has contact members of a copper bismuth alloy.

7. The circuit of claim 1 wherein the cell by-pass switch has vacuum circuit interrupters comprising a. an upper end plate and a lower end plate b. two contact members of a copper-bismuth alloy, each in mechanical and electrical connection with each end plate, each contact member having a contact surface, c. a flexible envelope, mechanically connected to the upper and lower end plate and enclosing the contact members, the envelope being constructed of a material which is impermeable to air and the mechanical connection of the envelope to the end plate being such that a vacuum is maintained in the space enclosed by the envelope and the end plates.

8. The circuit of claim 7 wherein the envelope is by weight an alloy of from about 66% to about 68% nickel from about 2% to about 4% iron, about 2% manganese and about 28% copper.

9. The circuit of claim 7 wherein the outer side of envelope is covered with an elastomeric coating.

10. The circuit of claim 7 wherein the envelope has convolutions.

11. The circuit of claim 7 wherein the envelope contains a ceramic ring which insulates the upper end plate from the lower end plate.

12. The circuit of claim 7 wherein the vacuum circuit interrupter also has guide pins in insulated arrangement between the end plates provided with spring means which are in insulated arrangement between the end plates.

13. The circuit of claim 12 wherein the envelope and guide pins are enclosed by an elastomeric sleeve.

14. The circuit of claim 7 wherein the end plates are oxygen free high conductivity copper.

15. The circuit of claim 7 wherein the contact surfaces are in substantially parallel arrangement.

16. The circuit of claim 7 wherein the cell by-pass switch comprises a plurality of switch assemblies each switch assembly comprising a plurality of vacuum circuit interrupters electrically connected in parallel and mounted on a chassis.

17. The circuit of claim 16 wherein the switch assembly comprises four vacuum circuit interrupters.

18. The circuit of claim 16 wherein the total current capacity of all of the switch assemblies for a cell is at least equal to the current drawn by the cell.

19. The circuit of claim 16 wherein the current is from about 1000 amperes to about 120,000 amperes.

20. The circuit of claim 16 wherein the switch assemblies are in mechanical connection with a single means for opening and closing the vacuum circuit interrupters.

21. The circuit of claim 20 wherein the vacuum circuit interrupters open and close in a substantially simultaneous manner.

* * * * *